US010301141B2

(12) United States Patent
Sato

(10) Patent No.: US 10,301,141 B2
(45) Date of Patent: May 28, 2019

(54) SHEET PROCESSING APPARATUS COMPRISING BINDING AND REGULATING MEMBERS, AND IMAGE FORMING APPARATUS COMPRISING SAME

(71) Applicant: KONICA MINOLTA, INC., Chiyoda-ku, Tokyo (JP)

(72) Inventor: Ryuji Sato, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/927,295

(22) Filed: Mar. 21, 2018

(65) Prior Publication Data

US 2018/0273336 A1 Sep. 27, 2018

(30) Foreign Application Priority Data

Mar. 23, 2017 (JP) ..... 2017-057073
Mar. 23, 2017 (JP) ..... 2017-057074

(51) Int. Cl.
*B65H 37/04* (2006.01)
*B31F 5/02* (2006.01)

(52) U.S. Cl.
CPC ..... *B65H 37/04* (2013.01); *B31F 5/02* (2013.01); *B31F 2201/00* (2013.01); *B65H 2301/43828* (2013.01); *B65H 2301/51616* (2013.01); *B65H 2403/531* (2013.01); *B65H 2801/27* (2013.01)

(58) Field of Classification Search
CPC ..... B65H 31/34; B65H 37/04; B65H 2301/51616; B31F 5/02; B31F 2201/00; B31F 2301/43828
See application file for complete search history.

(56) References Cited

U.S. PATENT DOCUMENTS 8,408,531 B2 * 4/2013 Sato ..... B65H 37/04 270/58.07
8,413,979 B2 * 4/2013 Sato ..... B65H 37/04 270/58.07
2010/0202814 A1 * 8/2010 Nakamura ..... B65H 37/04 399/408
2014/0077437 A1 * 3/2014 Abe ..... G03G 15/6541 270/58.12

(Continued)

FOREIGN PATENT DOCUMENTS

JP 2015006955 A 1/2015
JP 2015067407 A 4/2015

*Primary Examiner* — Patrick H MacKey
(74) *Attorney, Agent, or Firm* — Cantor Colburn LLP

(57) ABSTRACT

A sheet processing apparatus includes: a pair of binding members that respectively have a pair of crimping teeth facing each other, which move between binding positions where a sheet bundle is bound and retreat positions retreated from the binding positions; and a pair of regulating members that are arranged close to the binding members and respectively have a pair of regulating pieces which face each other and move between regulating positions where displacement of the sheet bundle bound by the pair of crimping teeth is regulated and retreat positions retreated from the regulating positions, wherein a separation distance between the pair of regulating pieces at the retreat positions of the regulating pieces is longer than a separation distance between the pair of crimping teeth at the retreat positions of the crimping teeth.

20 Claims, 19 Drawing Sheets

(56) References Cited

U.S. PATENT DOCUMENTS

| | | | | |
|---|---|---|---|---|
| 2014/0353900 | A1* | 12/2014 | Abe | B42B 5/00 270/58.08 |
| 2015/0093214 | A1* | 4/2015 | Takahashi | B42B 5/00 412/33 |
| 2016/0340144 | A1* | 11/2016 | Sakano | B65H 37/04 |

* cited by examiner

SHEET PROCESSING APPARATUS COMPRISING BINDING AND REGULATING MEMBERS, AND IMAGE FORMING APPARATUS COMPRISING SAME

CROSS-REFERENCE TO RELATED APPLICATIONS

The present invention claims priority under 35 U.S.C. § 119 to Japanese Patent Application No. 2017-057073, filed on Mar. 23, 2017, and Japanese Patent Application No. 2017-057074, filed on Mar. 23, 2017, the entire disclosure of which are incorporated herein by reference.

BACKGROUND

Technological Field

The present invention relates to a sheet processing apparatus and an image forming apparatus including the sheet processing apparatus.

Description of the Related Art

An image forming apparatus such as a copier may include a sheet processing apparatus that conveys and stacks sheets in a stepwise fashion by using a plurality of trays arranged in a sheet conveyance direction in order to orderly convey sheets such as printed paper sheets. The sheet processing apparatus is used when a plurality of the same documents is printed in one print job and it is desired to discharge sheets by bundling the sheets for each document.

Processing to bind a sheet bundle may be applied to a bundled sheet bundle. As the processing to bind a sheet bundle, staple processing that uses metal binding needles and crimping processing for crimping and binding a sheet bundle are proposed. In the crimping processing, a pair of concave-convex teeth pinches a sheet bundle, and the sheet bundle is bound by entangling fibers of the sheets. When a sheet bundle is bound by applying the crimping processing, there are advantages such as, consumables such as the binding needles are not required, damage to the sheets is small, and stacking performance is good because of flatness.

On the other hand, when binding a sheet bundle by applying the crimping processing, there is a problem that the sheet bundle attaches the teeth and it is difficult to remove the sheet bundle. JP2015-6955A and JP2015-67407A disclose examples of a conventional technique of a sheet processing apparatus proposed to solve the problem that may occur in such crimping processing.

The sheet processing apparatus described in JP2015-6955A includes a binding means that binds a sheet bundle by deforming the sheet bundle pinched by an upper tooth and a lower tooth in a thickness direction and a detaching means that detaches the sheet bundle from the teeth of the binding means by pressing the bound sheet bundle in the thickness direction. The detaching means detaches the sheet bundle from the teeth of the binding means when the binding means releases the pinching of the sheet bundle. Thereby, the sheet processing apparatus can prevent sheets from attaching to the teeth by a small and simple structure.

A paper binding apparatus described in JP2015-67407A includes a pair of crimping members which includes concave-convex tooth portions and pinches and binds a paper bundle and a separating means that separates the paper bundle from the crimping members. The separating means separates the paper bundle from the crimping members by causing a detaching member to come into contact with the paper bundle when the crimping members move from a binding position to a retreat position. Thereby, it is possible to provide a paper binding apparatus that prevents the paper bundle to which crimping/binding is applied from attaching to the crimping members.

SUMMARY

In the sheet processing apparatus described in JP2015-6955A, in a state in which the upper tooth and the lower tooth are located at retreat positions retreated from the binding positions, the detaching means protrudes between the upper tooth and the lower tooth that are away from each other. Similarly, in the paper binding apparatus described in JP2015-67407A, in a state in which a pair of tooth portions is located at retreat positions retreated from the binding positions, the detaching member protrudes between the pair of tooth portions that are away from each other. In the above techniques, there is a problem that an opening through which a sheet bundle is inserted to a binding area is small with respect to a separation interval between the pair of teeth. Therefore, there is concern that it is difficult to insert a large sheet bundle into the binding area.

The present invention has been made in view of the above problem, and an object of the present invention is to provide a sheet processing apparatus and an image forming apparatus which can exclude factors that cause a failure of insertion of a sheet bundle into a binding area where the sheet bundle is bound when the crimping processing for binding the sheet bundle by pinching the sheet bundle with a pair of crimping teeth is performed.

In the sheet processing apparatus described in JP2015-6955A, when the binding means starts releasing of the pinching of the sheet bundle, the detaching means formed of a leaf spring detaches the sheet bundle from the teeth of the binding means by using its elastic force. In the paper binding apparatus described in JP2015-67407A, when the crimping members are released from the binding positions by a predetermined length, the detaching member comes into contact with the paper bundle. In other words, these apparatuses perform an operation in which the detaching means and the detaching member relatively move away with respect to the crimping teeth by interlocking with the binding means and the crimping members. Therefore, there is a problem that a force to detach the sheet bundle from the crimping teeth may not be able to be sufficiently applied.

The present invention has been also made in view of the above problem, and another object of the present invention is to provide a sheet processing apparatus and an image forming apparatus which can improve function to prevent sheets from attaching to the crimping teeth when performing the crimping processing for binding the sheet bundle by pinching the sheet bundle with a pair of crimping teeth.

To achieve at least one of the abovementioned objects, according to an aspect of the present invention, a sheet processing apparatus reflecting one aspect of the present invention comprises: a pair of binding members that respectively have a pair of crimping teeth facing each other, which move between binding positions where a sheet bundle is bound and retreat positions retreated from the binding positions; and a pair of regulating members that are arranged close to the binding members and respectively have a pair of regulating pieces which face each other and move between regulating positions where displacement of the sheet bundle bound by the pair of crimping teeth is regulated and retreat positions retreated from the regulating positions, wherein a separation distance between the pair of regulating pieces at the retreat positions of the regulating pieces is longer than a separation distance between the pair of crimping teeth at the retreat positions of the crimping teeth.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

First Embodiment

Figure 1:
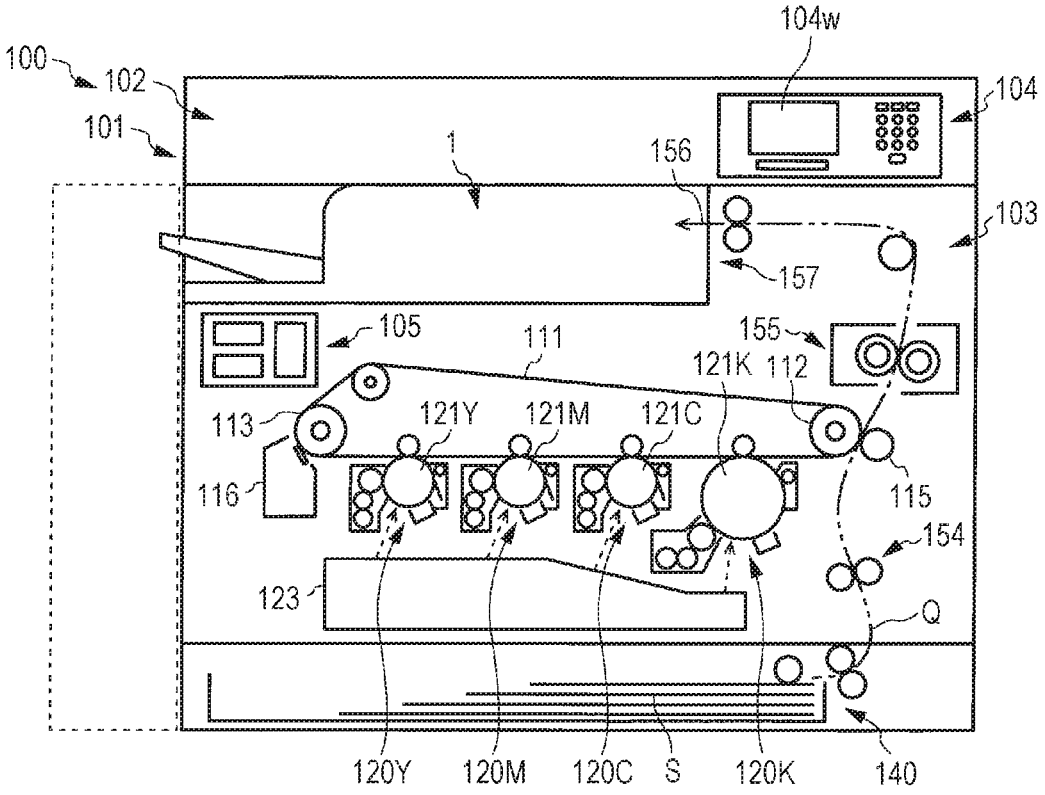
FIG. 1 is a partial vertical cross-sectional front view of an image forming apparatus of a first embodiment of the present invention.

First, an outline of a structure of an image forming apparatus of the first embodiment of the present invention will be described with reference to FIG. 1, and an image output operation will also be described. FIG. 1 is an example of a partial vertical cross-sectional front view of the image forming apparatus. A two-dot chain line with an arrow in FIG. 1 indicates a conveyance path and a conveyance direction of a sheet. A vertical direction, a horizontal direction, and a paper depth direction in FIG. 1 are a vertical direction, a horizontal direction, and a front-rear direction of the image forming apparatus.

The image forming apparatus 100 is a color copier of a so-called tandem type as shown in FIG. 1 and includes an image reading unit 102 that reads an image of an original document, a printing unit 103 that prints the read image on a sheet such as a paper sheet, an operation unit 104 for inputting printing conditions and displaying an operating state, and a main control unit 105.

The image reading unit 102 is a known unit, which reads an image of an original document placed on an upper surface of a platen glass by moving a scanner not shown in FIG. 1. The image of the original document is color-separated into three colors of red (R), green (G), and blue (B) and converted into an electrical signal by a CCD (Charge Coupled Device) image sensor not shown in FIG. 1. Thereby, the image reading unit 102 obtains image data separated into red (R), green (G), and blue (B).

In the main control unit 105, various processings are performed on the color-separated image data obtained by the image reading unit 102, and the color-separated image data is converted into image data of reproduction colors of yellow (Y), magenta (M), cyan (C), and black (K) and stored into a memory (not shown in the FIG. 1) of the main control unit 105. The image data of the reproduction colors stored into the memory receives processing for displacement correction and thereafter the image data is read for each scanning line in synchronization with conveyance of the sheet in order to perform optical scanning on a photoreceptor drum 121 which is an image carrier.

The printing unit 103 forms an image by an electrophotographic method and transfers the image to the sheet. The printing unit 103 includes an intermediate transfer belt 111 where an intermediate transfer body is formed into an endless belt. The intermediate transfer belt 111 is wound around a plurality of rollers including a driving roller 112 and a driven roller 113. The intermediate transfer belt 111 is rotated by the driving roller 112 in a counterclockwise direction in FIG. 1.

The driving roller 112 presses and comes into contact with a secondary transfer roller 115 which the driving roller 112 faces with the intermediate transfer belt 111 in between. At a position of the driven roller 113, an intermediate transfer cleaning unit 116 provided so as to face the driven roller 113 with the intermediate transfer belt 111 in between is in contact with an outer circumferential surface of the intermediate transfer belt 111. After a toner image formed on the outer circumferential surface of the intermediate transfer belt 111 is transferred to the sheet, the intermediate transfer cleaning unit 116 performs cleaning by removing adhered substances such as toner, which remain on the outer circumferential surface of the intermediate transfer belt 111.

Image forming units 120Y, 120M, 120C, and 120K respectively corresponding to the reproduction colors of yellow (Y), magenta (M), cyan (C), and black (K) are provided under the intermediate transfer belt 111. In this description, the image forming units 120Y, 120M, 120C, and 120K may be collectively referred to as, for example, an "image forming unit 120" by omitting an identification symbol "Y", "M", "C", or "K" that represents a color except for a case where it is especially required to limit a color. The four image forming units 120 are arranged in a row from an upstream side to a downstream side of a rotation direction of the intermediate transfer belt 111 along the rotation direction of the intermediate transfer belt 111. Each of the four image forming units 120 has the same configuration and includes a charging unit, an exposure unit (a scanning optical apparatus 123), a developing unit, a drum cleaning unit, and a primary transfer roller around the photoreceptor drum 121 that rotates clockwise in FIG. 1.

The scanning optical apparatus 123, which is an exposure apparatus, is arranged below the image forming units 120. One scanning optical apparatus 123 deals with the four image forming units 120 and has four light sources such as semiconductor lasers (not shown in FIG. 1) respectively corresponding to the four photoreceptor drums 121. The scanning optical apparatus 123 modulates four semiconductor lasers according to image gradation data of each reproduction color and emits laser light corresponding to each reproduction color to the four photoreceptor drums 121, respectively.

A sheet supply apparatus 151 is provided below the scanning optical apparatus 123. The sheet supply apparatus 151 stores a plurality of stacked sheets S inside thereof and feeds the sheets S one by one in order from the uppermost sheet to a conveyance path Q. The sheet S fed from the sheet supply apparatus 151 to the conveyance path Q reaches a position of a resist roller pair 154. Then, the resist roller pair 154 feeds the sheet S toward a contact portion (a secondary transfer nip portion) between the intermediate transfer belt 111 and the secondary transfer roller 115 in synchronization with rotation of the intermediate transfer belt 111 while correcting oblique feeding (skew) of the sheet S.

In the image forming unit 120, an electrostatic latent image is formed on a surface of the photoreceptor drum 121 by the laser light emitted from the scanning optical apparatus 123, and the electrostatic latent image is visualized as a toner image by the developing unit The toner image formed on the surface of the photoreceptor drum 121 is primarily transferred to the outer circumferential surface of the intermediate transfer belt 111 at a position where the photoreceptor drum 121 faces the primary transfer roller with the intermediate transfer belt 111 in between. Then, the toner images on the image forming units 120 are sequentially transferred to the intermediate transfer belt 111 at predetermined timings while the intermediate transfer belt 111 rotates, so that a color toner image where toner images of four colors of yellow, magenta, cyan, and black are superposed is formed on the outer circumferential surface of the intermediate transfer belt 111.

The color toner image that is primarily transferred to the outer circumferential surface of the intermediate transfer belt 111 is transferred to the sheet S that is synchronously sent by the resist roller pair 154 at a secondary transfer nip portion which is formed by contact between the intermediate transfer belt 111 and the secondary transfer roller 115.

A fixing unit 155 is provided on the downstream side of the secondary transfer nip portion in a sheet conveyance direction. The sheet S to which an unfixed toner image is transferred at the secondary transfer nip portion is sent to the fixing unit 155, and the toner image is heated and pressed to be fixed to the sheet S. The sheet S that has passed through the fixing unit 155 is discharged to a sheet discharge unit 157 through a sheet discharge port 156 provided above the intermediate transfer belt 111.

The operation unit 104 is provided on the front side of the image reading unit 102. The operation unit 104 receives input of settings of printing conditions such as type and size of the sheet S, magnification/reduction, and the presence or absence of duplex printing, and input of settings such as a fax number and a sender name in facsimile transmission. Further, the operation unit 104 plays a role of a notification unit for notifying a user of, for example, a state of the apparatus, precautions, an error message, and the like by displaying those on a display unit 104*w*.

Further, the image forming apparatus 100 is provided with a main control unit 105 composed of a CPU and an image processing unit that are not shown in FIG. 1 and other electronic components not shown in FIG. 1 for controlling an operation of the entire image forming apparatus 100. The main control unit 105 realizes a series of image forming operations and printing operations by controlling components such as the image reading unit 102 and the printing unit 103 on the basis of a program and data, which are inputted and stored into a memory, by using the CPU, which is a central processing unit, and the image processing unit.

The image forming apparatus 100 includes a sheet processing apparatus 1. The sheet processing apparatus 1 is provided in the sheet discharge unit 157 of the image forming apparatus 100 as shown in FIG. 1 and is detachably connected to a main body unit 101. The sheet S that has passed through the fixing unit 155 reaches the sheet processing apparatus 1 through the sheet discharge port 156.

For the sheets S to which toner image is fixed, for example, when a plurality of the same documents is printed in one print job, the sheet processing apparatus 1 can discharge the sheets S by bundling the sheets S for each document. Further, the sheet processing apparatus 1 can apply post-processing such as, for example, binding processing (crimping processing or staple processing) of a sheet bundle, punch processing, and twofold processing. It is possible to install the sheet processing apparatus in a position which is indicated by a dashed line in FIG. 1 and which is on the left side of the main body unit 101 when the image forming apparatus 100 is viewed from the front side.

Figure 2:
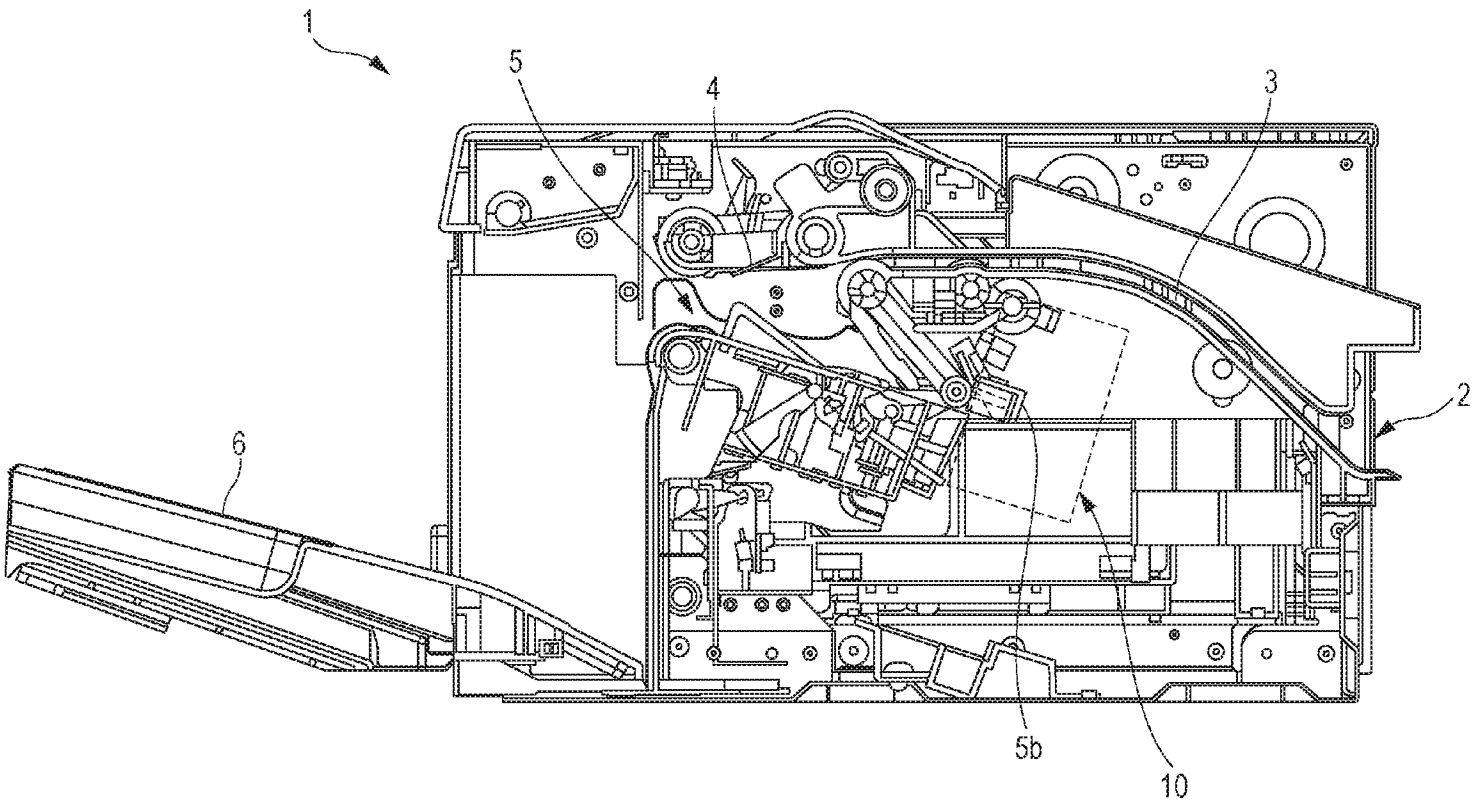
FIG. 2 is a vertical cross-sectional front view of a sheet processing apparatus of the first embodiment of the present invention.

Next, a schematic configuration of the sheet processing apparatus 1 of the image forming apparatus 100 will be described with reference to FIG. 2. FIG. 2 is a vertical cross-sectional front view of the sheet processing apparatus 1.

As shown in FIG. 2, the sheet processing apparatus 1 includes a sheet carrying-in port 2, a sheet discharging path 3, a pusher 4, an intermediate tray 5, a discharge tray 6, and a binding apparatus 10.

The sheet carrying-in port 2 is provided in a side surface facing the sheet discharge port 156 of the image forming apparatus 100 and has an opening in the side surface. The sheet S that has passed through the fixing unit 155 is carried into the inside of the sheet processing apparatus 1 through the sheet carrying-in port 2.

The sheet discharging path 3 extends from the sheet carrying-in port 2 to above the intermediate tray 5. The pusher 4 is arranged on the downstream side of the sheet discharging path 3 in the sheet conveyance direction. The intermediate tray 5 is arranged below a downstream portion of the sheet discharging path 3 and below the pusher 4. The sheet S that is conveyed in the sheet discharging path 3 comes into contact with the pusher 4, is pressed down, and falls freely to an upper surface of the intermediate tray 5. The discharge tray 6 is arranged on the downstream side of the intermediate tray 5 in the sheet conveyance direction.

The intermediate tray 5 and the discharge tray 6 have an upward gradient as the sheet placement surface 5*a* goes toward the downstream side in the sheet conveyance direction. A user can take out the sheet S discharged to the discharge tray 6.

The binding apparatus 10 is arranged on the upstream side of the intermediate tray 5 in the sheet conveyance direction. The binding apparatus 10 is an example of a post-processing apparatus arranged on the upstream side of the intermediate tray 5 in the sheet conveyance direction. The sheet processing apparatus 1 can apply crimping processing to a bundle of the sheets S conveyed to the intermediate tray 5 and bind the sheet bundle by using the binding apparatus 10.

The intermediate tray 5 is provided with a conveyance mechanism not shown in the drawings. The sheet processing apparatus 1 conveys the sheet S, which has been placed on the intermediate tray 5 and has been applied with post-processing, to the discharge tray 6 provided on the downstream side of the intermediate tray 5 in the sheet conveyance direction by using the conveyance mechanism.

Figure 3:
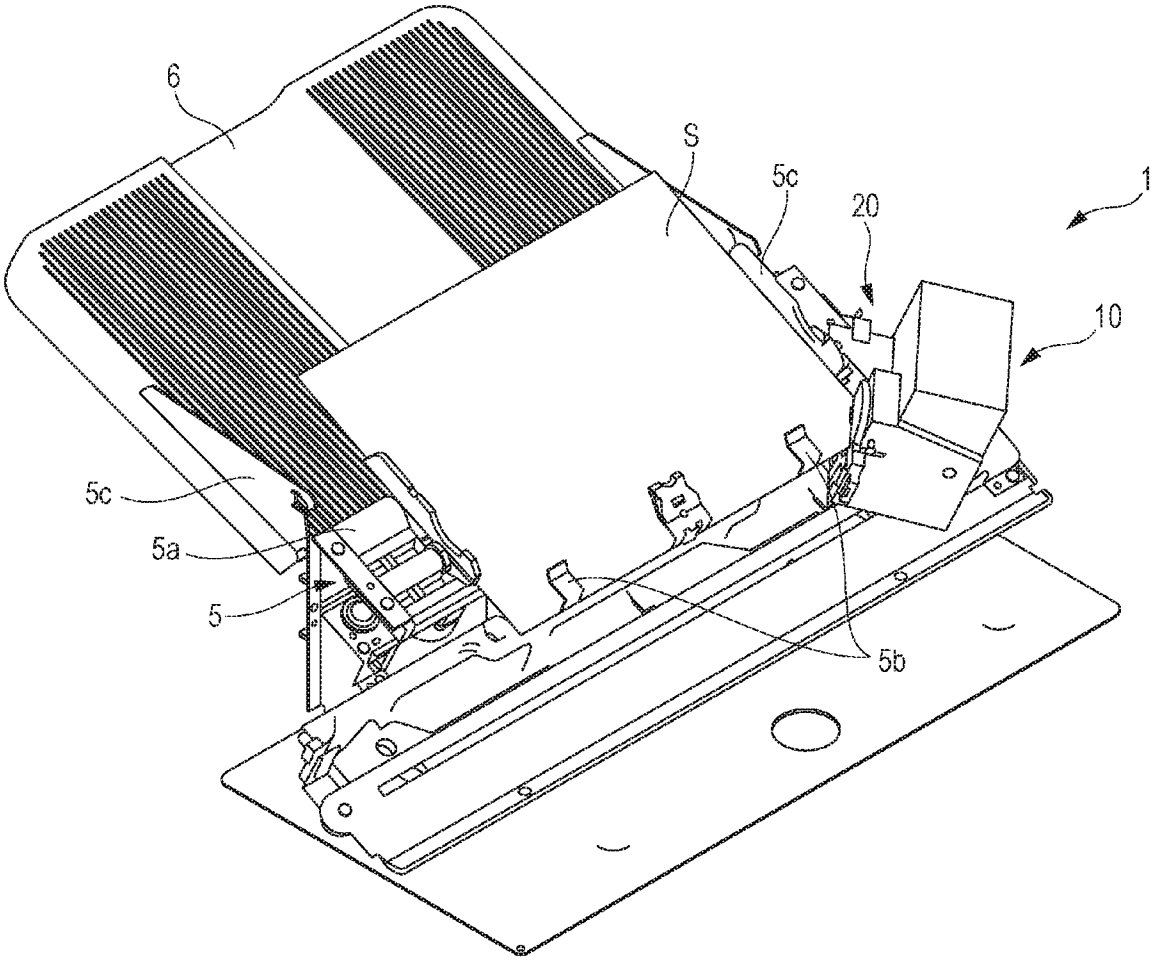
FIG. 3 is a partial perspective view of the sheet processing apparatus of the first embodiment of the present invention.
Figure 4:
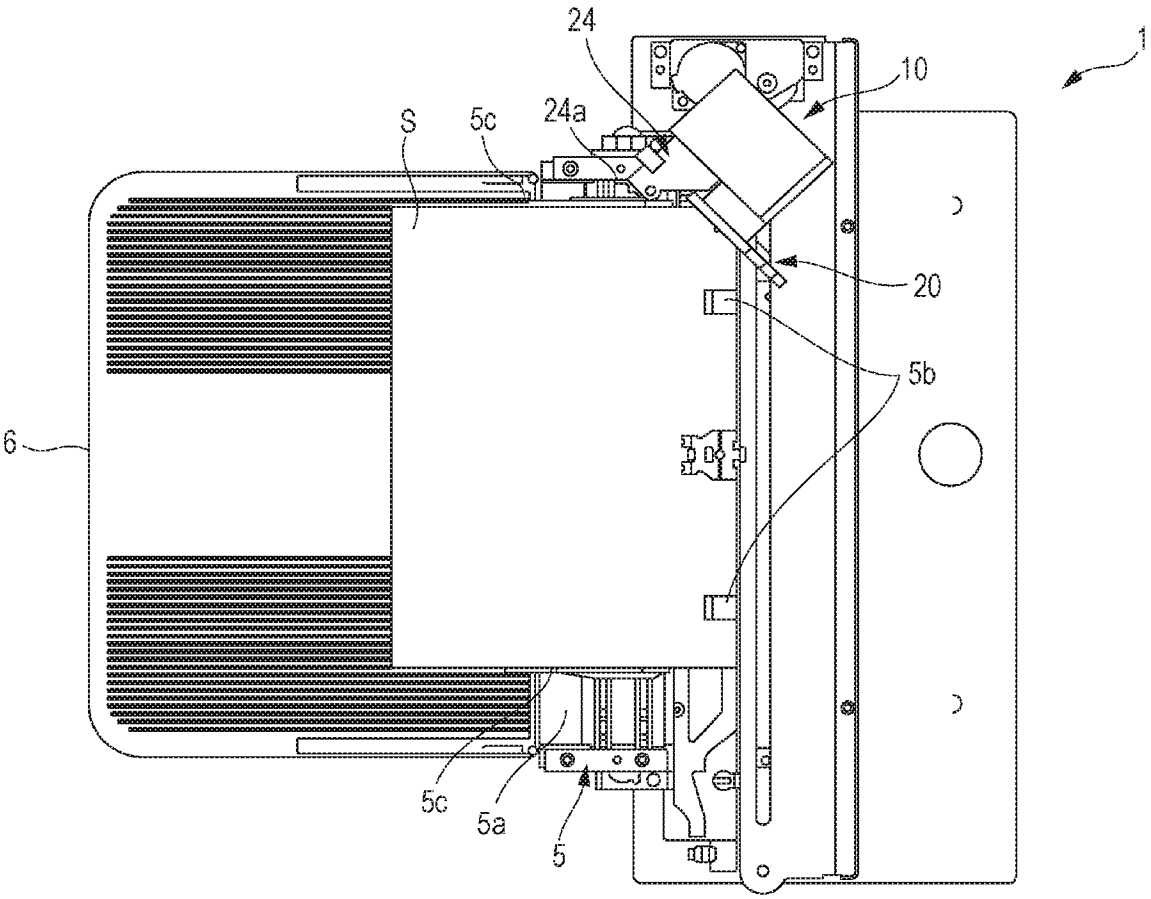
FIG. 4 is a partial top view of the sheet processing apparatus of the first embodiment of the present invention.

Next, a detailed configuration of the intermediate tray 5 and the binding apparatus 10 of the sheet processing apparatus 1 will be described with reference to FIGS. 3 to 8. FIGS. 3 and 4 are a partial perspective view and a partial top view of the sheet processing apparatus 1. FIGS. 5, 6, 7, and 8 are a perspective view, a front view, a top view, and a side view of the binding apparatus 10.

As show in FIG. 3 and FIG. 4, the intermediate tray 5 includes a sheet placement surface 5*a* on its upper surface. As described above, the sheet placement surface 5*a* an upward gradient as it goes toward the downstream side in the sheet conveyance direction. The intermediate tray 5 receives the sheet S that falls freely from the sheet discharging path 3 on the sheet placement surface 5*a*.

The intermediate tray 5 includes end fences 5*b* on its upstream end in the sheet conveyance direction. The end fence 5*b* is provided at two positions along a sheet width direction crossing the sheet conveyance direction. The end fence 5*b* comes into contact with a conveyance direction upstream side end face (rear end) of the sheet S that slides toward the upstream side on the sheet placement surface 5*a* along the gradient of the sheet placement surface 5*a*. Thereby, the end fence 5*b* regulates and aligns a position of the conveyance direction upstream end of the sheet S.

The intermediate tray 5 includes a side fence 5*c*, which is an aligning member of a sheet bundle, near its both ends in the sheet width direction crossing the sheet conveyance direction, that is, on the front side and the rear side of the sheet S. The side fences 5*c* are provided movably in the sheet width direction and come into contact with the sheet bundle from outside the front of the sheet bundle and from outside the rear of the sheet bundle. Thereby, the side fences 5*c* regulate and align positions of the sheets S in the width direction.

As shown in FIGS. 3 and 4, the binding apparatus 10 is provided at the upstream end of the intermediate tray 5 in the sheet conveyance direction and near a rear side end portion of the intermediate tray 5 in the sheet width direction. The binding apparatus 10 is formed into a substantially rectangular parallelepiped shape having a substantially rectangular shape in plan view and, for example, is arranged inclined at an angle of 45° with respect to the sheet conveyance direction. Thereby, the binding apparatus 10 performs crimping/binding processing on a corner portion of the sheet bundle having a rectangular shape in plan view in a state in which the binding apparatus 10 is inclined at an angle of 45° with respect to the sheet conveyance direction, and binds the sheet bundle.

As shown in FIGS. 5 to 8, the binding apparatus 10 includes an opening portion 11, a pair of binding members 12A and 12B, a cam 13, and a motor 14 (shown in FIG. 8) in its housing 10*a*.

The opening portion 11 is arranged in a front surface, which faces the sheet bundle, of the housing 10*a* of the binding apparatus 10. The opening portion 11 is provided at substantially the same height as that of the sheet bundle placed on the sheet placement surface 5*a* of the intermediate tray 5. The opening portion 11 is formed into a rectangular shape extending in a direction substantially in parallel with front and rear surfaces of the sheet bundle when the housing 10*a* is seen from the front. When the crimping/binding processing is applied, a corner portion of the sheet bundle is inserted into inside of the binding apparatus 10 through the opening portion 11.

Figure 8:
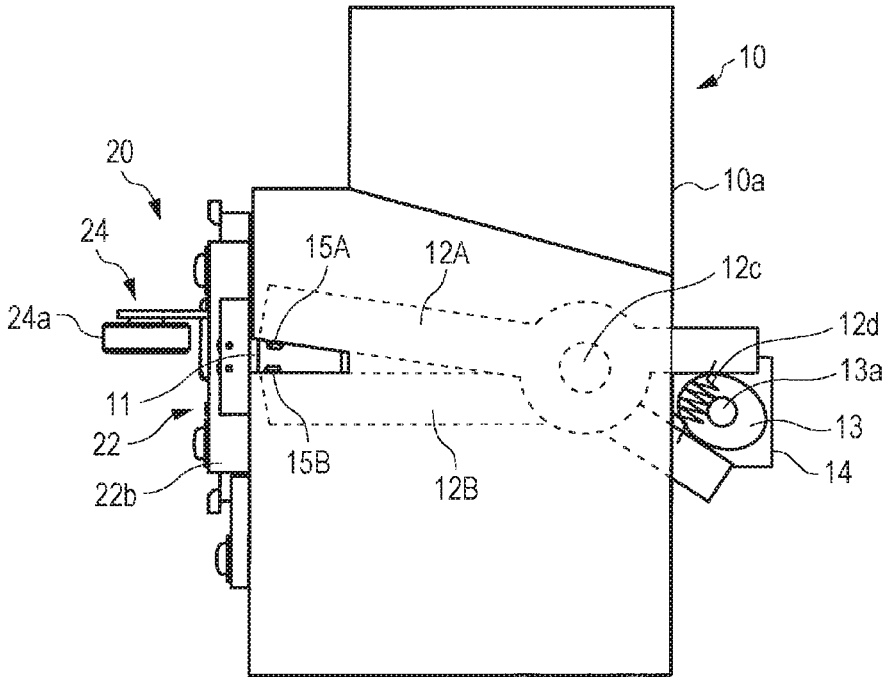
FIG. 8 is a side view of the binding apparatus of the sheet processing apparatus of the first embodiment of the present invention.

As shown in FIG. 8, the pair of binding members 12A and 12B are provided inside the housing 10*a* as seen from the opening portion 11. The pair of binding members 12A and 12B are connected through a support shaft 12*c* to form a so-called scissors-shape. The support shaft 12*c* extends in a direction substantially in parallel with the front and rear surfaces of the sheet bundle placed on the sheet placement surface 5*a*. The pair of binding members 12A and 12B swing in a vertical direction crossing the front and rear surfaces of the sheet bundle around a shaft line of the support shaft 12*c*.

The pair of binding members 12A and 12B respectively have a pair of crimping teeth 15A and 15B facing each other at positions corresponding to working points of the pair of binding members 12A and 12B having the scissors-shape. The pair of crimping teeth 15A and 15B are provided close to the opening portion 11. The pair of crimping teeth 15A and 15B are arranged on a back side of a central portion of the opening portion 11 formed into a rectangular shape extending in a direction substantially in parallel with the front and rear surfaces of the sheet bundle when the housing 10*a* is viewed from the front. The binding members 12A and 12B bind the sheet bundle by nipping a corner portion of the sheet bundle inserted into inside the housing 10*a* from the opening portion 11 by using the pair of crimping teeth 15A and 15B.

The cam 13 is a portion corresponding to a point of effort of the pair of binding members 12A and 12B having the scissors-shape. The cam 13 is provided on the rear surface side of the housing 10*a* that faces the sheet bundle on the front surface side. A rotating shaft 13*a* of the cam 13 extends in parallel with the support shaft 12*c* of the pair of binding members 12A and 12B. The cam 13 is arranged by being sandwiched between the pair of binding members 12A and 12B. A spring 12*d* that energizes a binding area that is bound by the pair of crimping teeth 15A and 15B in a direction where the binding area is opened is provided to the pair of binding members 12A and 12B, so that an outer circumference surface of the cam 13 is in contact with each of the binding members 12A and 12B at all times.

The motor 14 is a driving part that displaces the binding members 12A and 12B. The motor 14 is arranged close to the cam 13. The motor 14 rotates the rotating shaft 13*a* of the cam 13. The binding apparatus 10 swings the pair of binding members 12A and 12B having the scissors-shape through the cam 13 by driving the motor 14. Thereby, the pair of crimping teeth 15A and 15B move between binding positions where the sheet bundle is bound and retreat positions retreated from the binding positions. FIG. 8 shows a state in which the pair of crimping teeth 15A and 15B are located at the retreat positions.

Figure 5:
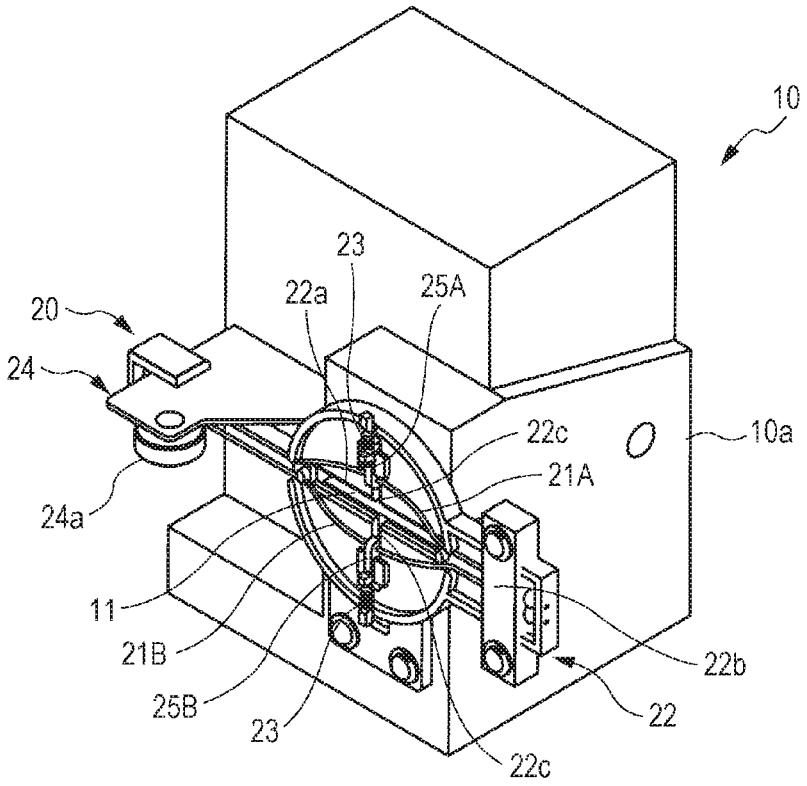
FIG. 5 is a perspective view of a binding apparatus of the sheet processing apparatus of the first embodiment of the present invention.
Figure 6:
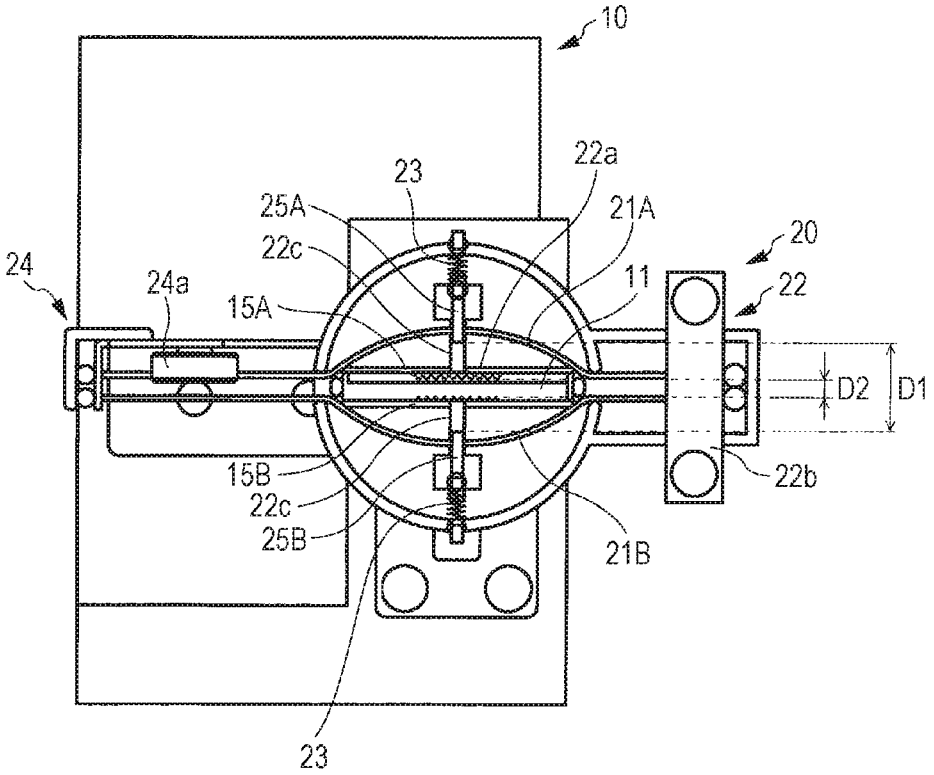
FIG. 6 is a front view of the binding apparatus of the sheet processing apparatus of the first embodiment of the present invention.
Figure 7:
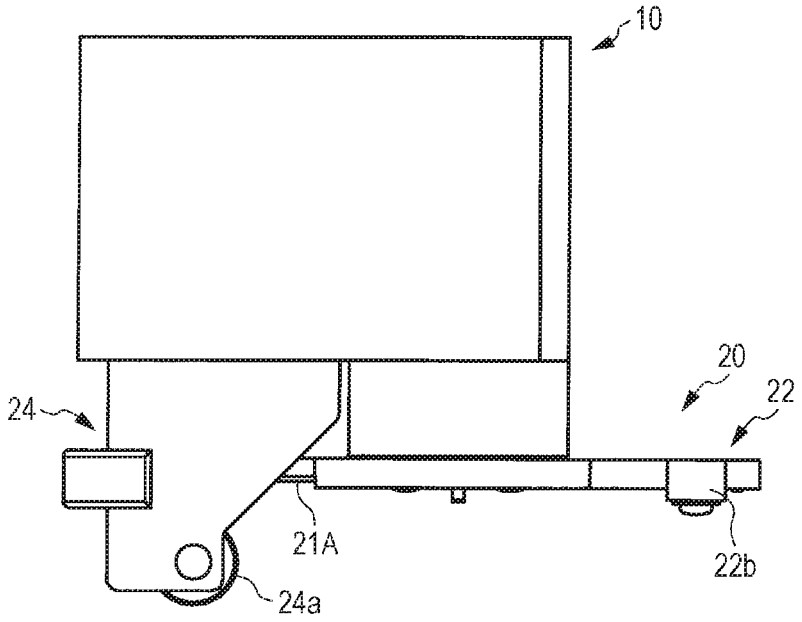
FIG. 7 is a top view of the binding apparatus of the sheet processing apparatus of the first embodiment of the present invention.

As shown in FIGS. 3 to 8, the binding apparatus 10 supports a regulating apparatus 20 of a sheet bundle. The regulating apparatus 20 is arranged close to the opening portion 11 of the binding apparatus 10. The regulating apparatus 20 includes two wires 21A and 21B which are a pair of regulating members, a support member 22, a spring 23, and a slide member 24. In FIGS. 7 and 8, the spring 23 is omitted.

The two wires 21A and 21B are provided on a front side of the binding apparatus 10 and on a sheet bundle side in front of the opening portion 11. The two wires 21A and 21B are arranged close to the binding members 12A and 12B. The two wires 21A and 21B are laid in substantially parallel with each other above and below the sheet bundle with the sheet bundle in between. One ends of the two wires 21A and 21B are supported by the support member 22, and the other ends are supported by the slide member 24.

The two wires 21A and 21B respectively have a pair of regulating pieces 25A and 25B facing each other with the sheet bundle in between. The pair of regulating pieces 25A and 25B are provided close to the opening portion 11. The pair of regulating pieces 25A and 25B are arranged in front of a central portion of the opening portion 11 formed into a rectangular shape extending in a direction substantially in parallel with the front and rear surfaces of the sheet bundle when the housing 10*a* is viewed from the front. Each of the pair of regulating pieces 25A and 25B is formed into a substantially rod shape extending in the vertical direction.

Two wires 21A and 21B penetrate the pair of regulating pieces 25A and 25B, respectively, and the pair of regulating pieces 25A and 25B interlock with the wires 21A and 21B. The two wires 21A and 21B move the pair of regulating pieces 25A and 25B in a direction crossing a surface of the sheet bundle. According to this configuration, the pair of regulating pieces 25A and 25B do not rotate around a predetermined shaft line to approach the sheet bundle as in a conventional technique, so that is it possible to suppress position deviation of the sheet bundle.

The pair of regulating pieces 25A and 25B approach a corner portion of the sheet bundle, which is inserted into inside of the housing 10*a* from the opening portion 11, from the vertical direction. Thereby, the two wires 21A and 21B regulate displacement of the sheet bundle bound by the crimping teeth 15A and 15B in directions approaching and moving away from the crimping teeth 15A and 15B by using the pair of regulating pieces 25A and 25B.

The pair of regulating pieces 25A and 25B have a shape in which portions facing each other, that is, a lower end portion of the upper regulating piece 25A and an upper end portion of the lower regulating piece 25B, protrude toward each other. Thereby, when the pair of regulating pieces 25A and 25B come into contact with the sheet bundle at regulating positions thereof, the pair of regulating pieces 25A and 25B come into line contact with the sheet bundle. According to this configuration, it is possible to stably regulate displacement of the sheet bundle over a wide range by using the pair of regulating pieces 25A and 25B.

The support member 22 is fixed to the front surface of the binding apparatus 10. The support member 22 supports the two wires 21A and 21B on its front side and on a side where the sheet bundle is placed. In the support member 22, an area adjacent to the opening portion 11 is formed into a circular shape in a front view. The support member 22 has a window portion 22*a* at a position of the opening portion 11. The window portion 22*a* is formed into substantially the same shape and substantially the same size as those of the opening portion 11. The corner portion of the sheet bundle is inserted into inside of the housing 10*a* through the window portion 22*a* and the opening portion 11.

The support member 22 has a support tool 22*b*. The support tool 22*b* protrudes from an outer edge portion of the circular area of the support member 22 toward the upstream side in the sheet conveyance direction. The support tool 22*b* immovably supports one end of each of the two wires 21A and 21B. The support tool 22*b* can adjust support positions of the wires 21A and 21B in a direction substantially in parallel with the front and rear surfaces of the sheet bundle.

The support member 22 has rail portions 22*c*, which are orthogonal to the opening portion 11 and extend in the vertical direction, over and under a central portion of the window portion 22*a*. The pair of regulating pieces 25A and 25B engage with the upper and lower rail portions 22*c*, respectively. The regulating pieces 25A and 25B can move in the vertical direction along a direction in which the rail portions 22*c* extend. Thereby, the pair of regulating pieces 25A and 25B can move between the regulating positions where the regulating pieces 25A and 25B approach the opening portion 11 and regulate displacement of the sheet bundle and the retreat positions where the regulating pieces 25A and 25B move away from the opening portion 11 in the vertical direction and retreat from the regulating positions.

The spring 23 is attached to the support member 22. The spring 23 is provided to two positions which are above and below the opening portion 11. The spring 23 is composed of, for example, an extension coil spring. One end of one spring 23 is connected to an upper edge portion of the support member 22 and the other end is connected to the upper regulating piece 25A. One end of the other spring 23 is connected to a lower edge portion of the support member 22 and the other end is connected to the lower regulating piece 25B. The springs 23 expand and contract in the vertical direction along with vertical movement of the regulating pieces 25A and 25B along the rail portions 22*c*. Thereby, the springs 23 energize the pair of regulating pieces 25A and 25B toward the retreat positions.

The slide member 24 is provided to an opposite side of an area, where the support tool 22*b* is arranged, with the circular area of the support member 22 in between. While the support tool 22*b* supports one end of each of the two wires 21A and 21B, the slide member 24 supports the other end of each of the two wires 21A and 21B. The slide member 24 can move in a direction substantially in parallel with the front and rear surfaces of the sheet bundle along a guide portion not shown in the drawings. In other words, the slide member 24 moves end portions of the two wires 21A and 21B substantially in parallel with the surface of the sheet bundle. Thereby, the slide member 24 can change tension of each of the two wires 21A and 21B. When the slide member 24 moves in a direction to increase the tension of each of the two wires 21A and 21B, that is, a direction to move away from the support member 22, the slide member 24 can move the pair of regulating pieces 25A and 25B toward the regulating positions against the energizing force of the spring 23.

The slide member 24 include a contact member 24*a*. The contact member 24*a* is provided at an end portion of the slide member 24 on a side where the sheet bundle is placed. The contact member 24*a* is composed of a wheel that can rotate around a support shaft extending in the vertical direction. The side fence 5*c* provided on the rear side of the sheet bundle is in contact with the contact member 24*a*. The slide member 24 interlocks with the side fence 5*c*. The side fence 5*c* displaces the two wires 21A and 21B through the slide member 24, so that the side fence 5*c* is a driving part of the two wires 21A and 21B.

Figure 9:
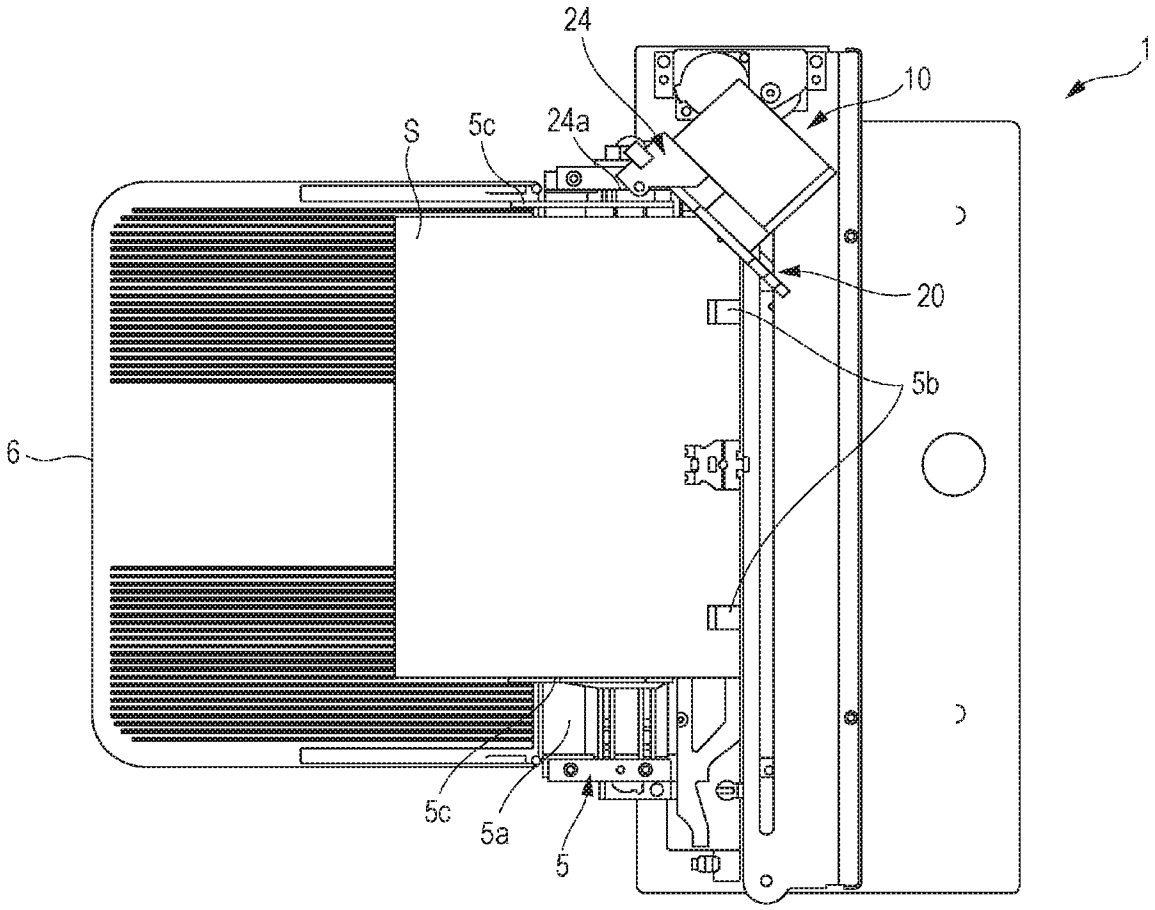
FIG. 9 is a partial top view showing a bound state of a sheet bundle bound by a binding apparatus of the sheet processing apparatus of the first embodiment of the present invention.
Figure 10:
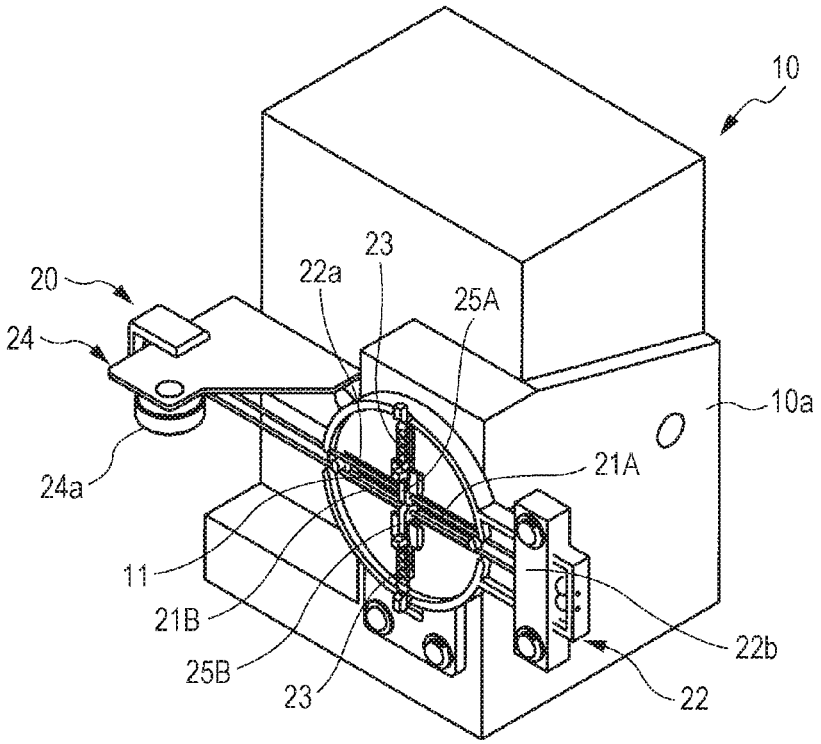
FIG. 10 is a perspective view showing a binding state of a sheet bundle of the binding apparatus of the sheet processing apparatus of the first embodiment of the present invention.
Figure 11:
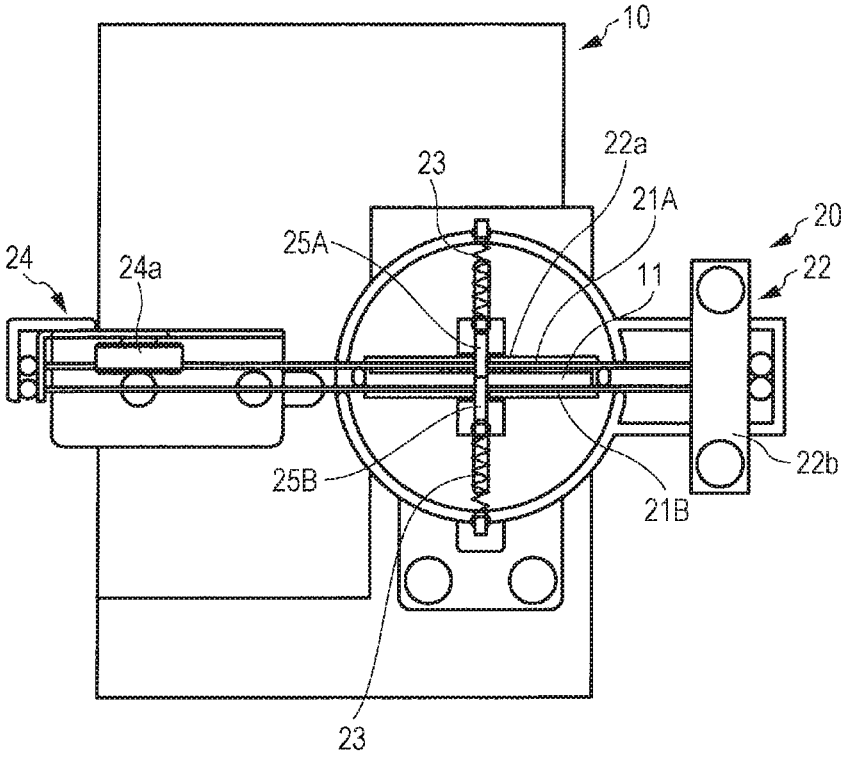
FIG. 11 is a front view showing the binding state of the sheet bundle of the binding apparatus of the sheet processing apparatus of the first embodiment of the present invention.
Figure 12:
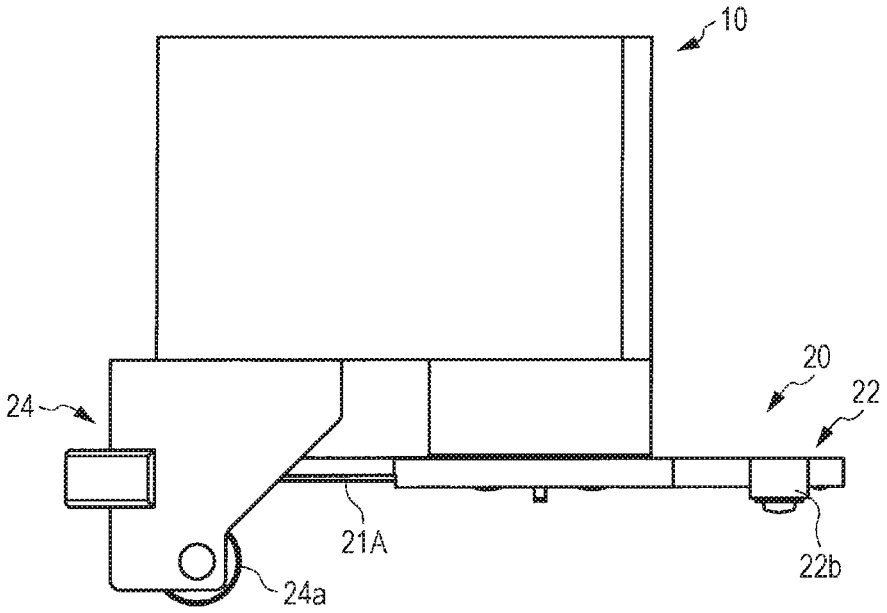
FIG. 12 is a top view showing the binding state of the sheet bundle of the binding apparatus of the sheet processing apparatus of the first embodiment of the present invention.

Next, the crimping/binding processing of a sheet bundle performed by the sheet processing apparatus 1 will be described with reference to FIGS. 9 to 12 in addition to FIGS. 2 to 8. FIG. 9 is a partial top view showing a bound state of a sheet bundle bound by a binding apparatus 10 of the sheet processing apparatus 1. FIGS. 10, 11, and 12 are a perspective view, a front view, and a top view showing a binding state of the sheet bundle of the binding apparatus 10. In FIGS. 10 to 12, the sheet S is omitted. In FIG. 12, the spring 23 is omitted.

As described above, the sheet S that is conveyed in the sheet discharging path 3 comes into contact with the pusher 4, is pressed down, and falls freely to the upper surface of the intermediate tray 5 (see FIG. 2). Then, a predetermined number of sheets S are mounted on the sheet placement surface 5*a* of the intermediate tray 5 and a sheet bundle is formed. The end fences 5*b* regulate and align a position of a conveyance direction upstream end of the sheet bundle. Subsequently, the side fences 5*c* come into contact with a front surface and a rear surface of the sheet bundle, and regulate and align a position in the width direction of the sheet bundle.

As shown in FIGS. 3 and 4, a corner portion on the rear side of the sheet bundle is inserted into the opening portion 11 of the binding apparatus 10 in a state in which the positions of the sheet bundle in the conveyance direction and the width direction are regulated on the sheet placement surface 5*a* of the intermediate tray 5. At this time, the side fence 5*c* on the rear side of the sheet bundle is not in contact with the contact member 24*a* of the slide member 24, or the side fence 5*c* comes into contact with the contact member 24*a* so that a load is slightly applied to the two wires 21A and 21B.

As shown in FIGS. 5 to 7, tension hardly occurs in the two wires 21A and 21B. Thereby, the spring 23 moves the pair of regulating pieces 25A and 25B to the retreat positions. At this time, as shown in FIG. 6, a separation distance D1 between the pair of regulating pieces 25A and 25B at the retreat positions of the regulating pieces 25A and 25B is longer than a separation distance D2 between the pair of crimping teeth 15A and 15B at the retreat positions of the crimping teeth 15A and 15B. According to this configuration, it is possible to exclude factors that cause a failure of insertion of the sheet bundle into a binding area of the sheet bundle when inserting the sheet bundle into the binding area of the sheet bundle.

Subsequently, as shown in FIG. 9, the side fence 5*c* on the rear side of the sheet bundle moves away from the sheet bundle and further moves toward the rear side. Thereby, the slide member 24 comes into contact with the side fence 5*c* and interlocks with the side fence 5*c*. The slide member 24 moves in a direction moving away from the support member 22.

Thereby, the slide member 24 increases tension of each of the two wires 21A and 21B and moves the pair of regulating pieces 25A and 25B toward the regulating positions against the energizing force of the spring 23. The pair of regulating pieces 25A and 25B come into contact with each other through the sheet bundle or come close to each other. In other words, the two wires 21A and 21B regulate displacement of the sheet bundle in directions approaching and moving away from the crimping teeth 15A and 15B by using the pair of regulating pieces 25A and 25B.

Subsequently, the binding apparatus 10 performs the crimping/binding processing on the sheet bundle. The binding apparatus 10 swings the pair of binding members 12A and 12B having the scissors-shape through the cam 13 by driving the motor 14. The pair of crimping teeth 15A and 15B individually move with respect to the binding positions where the sheet bundle is bound.

When the sheet processing apparatus 1 moves the pair of crimping teeth 15A and 15B and the pair of regulating pieces 25A and 25B to the binding positions or the regulating positions in this way, the sheet processing apparatus 1 moves the pair of crimping teeth 15A and 15B to the binding positions after moving the pair of regulating pieces 25A and 25B to the regulating positions. According to this configuration, the crimping processing is started after regulating displacement of the sheet bundle in a direction approaching or moving away from the crimping teeth 15A and 15B. Therefore, it is possible to prevent the sheet bundle from being displaced by transmission of vibration related to driving of the binding apparatus 10 to the sheet bundle.

After the crimping/binding processing of the sheet bundle, the binding apparatus 10 drives the motor 14 and individually moves the pair of crimping teeth 15A and 15B to the retreat positions retreated from the binding positions. Each of the pair of crimping teeth 15A and 15B individually moves with respect to the binding position and the retreat position, so that it is possible to prevent the sheet S from attaching to each of the pair of crimping teeth 15A and 15B.

Subsequently, the side fence 5*c* on the rear side of the sheet bundle approaches the sheet bundle to move to the front side. Thereby, the tension of each of the two wires 21A and 21B supported by the slide member 24 decreases, and the spring 23 moves the pair of regulating pieces 25A and 25B toward the retreat positions. Each of the pair of regulating pieces 25A and 25B individually moves with respect to the regulating position and the retreat position, so that it is possible to prevent the sheet S from attaching to each of the pair of crimping teeth 15A and 15B.

Here, when the sheet processing apparatus 1 moves the pair of crimping teeth 15A and 15B and the pair of regulating pieces 25A and 25B to their retreat positions, the sheet processing apparatus 1 holds the pair of regulating pieces 25A and 25B at the regulating positions until a separation distance between the pair of crimping teeth 15A and 15B reaches a predetermined separation distance. According to this configuration, after the crimping processing, when the pair of crimping teeth 15A and 15B are separated from each other, the pair of regulating pieces 25A and 25B are held at the regulating positions until the separation distance between the crimping teeth 15A and 15B reaches the predetermined separation distance. In other words, it is possible to regulate displacement of the sheet bundle in directions approaching and moving away from the crimping teeth 15A and 15B until the crimping teeth 15A and 15B are sufficiently separated from each other. Therefore, it is possible to effectively improve function to prevent the sheet S from attaching to the crimping teeth 15A and 15B.

It is preferable that after the pair of crimping teeth 15A and 15B located at the binding positions are moved to the retreat positions of the crimping teeth 15A and 15B, the pair of regulating pieces 25A and 25B located at the regulating positions are moved toward the retreat positions of the regulating pieces 25A and 25B. According to this configuration, it is possible to regulate displacement of the sheet bundle in directions approaching and moving away from the crimping teeth 15A and 15B until the crimping teeth 15A and 15B move to the retreat positions. Therefore, it is possible to effectively improve function to prevent the sheet S from attaching to the crimping teeth 15A and 15B.

Further, in the first embodiment described above, the two wires 21A and 21B are provided so as to be able to operate independently from the pair of binding members 12A and 12B. According to this configuration, it is possible to easily realize a form in which the separation distance D1 between the pair of regulating pieces 25A and 25B is longer than the separation distance D2 between the pair of crimping teeth 15A and 15B. Further, the driving part (the motor 14) of the binding members 12A and 12B is different from the driving part (the side fence 5*c*) of the wires 21A and 21B. According to this configuration, it is possible to easily realize timing when the regulating pieces 25A and 25B move to their retreat positions after the crimping teeth 15A and 15B move to their retreat positions.

Further, in the first embodiment described above, a part of the two wires 21A and 21B is displaced through the slide member 24 in a direction crossing a moving direction of the pair of crimping teeth 15A and 15B. According to this configuration, it is possible to use the side fence 5*c* as a driving part of the two wires 21A and 21B. Further, the slide member 24 comes into contact with and interlocks with the side fence 5*c*, and the pair of regulating pieces 25A and 25B move to the regulating positions through the two wires 21A and 21B. According to this configuration, it is not necessary to separately provide a driving part of the two wires 21A and 21B.

Further, in the first embodiment described above, in the regulating apparatus 20, a pair of regulating members that regulate displacement of the sheet bundle in directions approaching and moving away from the crimping teeth 15A and 15B by using the pair of regulating pieces 25A and 25B are composed of the two wires 21A and 21B which are laid in substantially parallel with each other with the sheet bundle in between, and the regulating apparatus 20 includes the support tool 22*b* that immovably supports one ends of the two wires 21A and 21B, the slide member 24 that moves the other ends of the two wires 21A and 21B substantially in parallel with the surface of the sheet bundle and moves the pair of regulating pieces 25A and 25B toward the regulating positions, and the springs 23 that energize the pair of regulating pieces 25A and 25B toward the retreat positions. According to this configuration, it is possible to move the pair of regulating pieces 25A and 25B to suitable regulating positions or suitable retreat positions by utilizing characteristics of the wires 21A and 21B that change their shapes flexibly.

Further, in the first embodiment described above, the pair of regulating pieces 25A and 25B are arranged on the upstream side of the pair of crimping teeth 15A and 15B in an insertion direction of the sheet bundle. According to this configuration, it is possible to configure so that the two wires 21A and 21B do not prevent operation of the pair of binding members 12A and 12B.

Further, in the first embodiment described above, it is possible to adjust the separation distance between the pair of regulating pieces 25A and 25B by adjusting the support positions of the two wires 21A and 21B supported by the support tool 22*b* in a direction substantially in parallel with the front and rear surfaces of the sheet bundle. According to this configuration, it is possible to set the tension of the two wires 21A and 21B to a suitable state. Therefore, it is possible to suitably determine the separation distance D1 between the pair of regulating pieces 25A and 25B and the separation distance D2 between the pair of crimping teeth 15A and 15B.

Further, in the first embodiment described above, the two wires 21A and 21B and the pair of binding members 12A and 12B are unitized. According to this configuration, when the size of the sheet S is changed, it is possible to move the two wires 21A and 21B and the pair of binding members 12A and 12B together and arrange them in appropriate positions.

Modified Example 1 of First Embodiment

Figure 13:
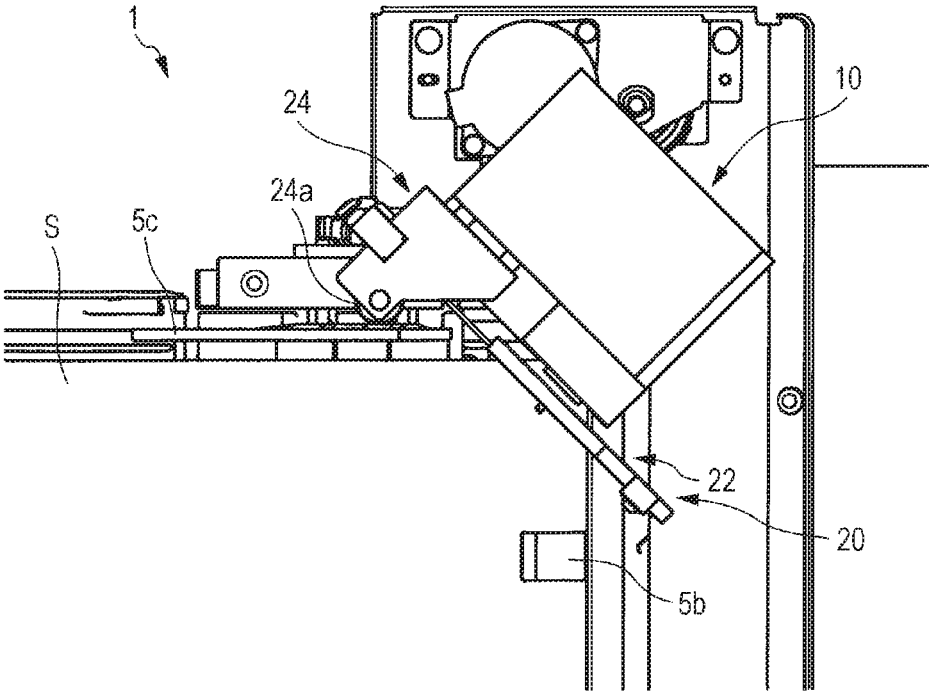
FIG. 13 is a partially enlarged top view of a modified example 1 of the sheet processing apparatus of the first embodiment of the present invention.

Next, a modified example 1 of the sheet processing apparatus 1 of the first embodiment will be described with reference to FIG. 13. FIG. 13 is a partially enlarged top view of the modified example 1 of the sheet processing apparatus 1.

In the modified example 1 of the sheet processing apparatus 1 of the first embodiment, the binding apparatus 10 and the regulating apparatus 20 are provided to be able to move independently from each other. For example, as shown in FIG. 13, in a state in which the regulating apparatus 20 regulates displacement of the sheet bundle by using the pair of regulating pieces 25A and 25B, the binding apparatus 10 can move in a direction moving away from the regulating apparatus 20.

According to this configuration, while the binding apparatus 10 performs binding at two or more locations, the regulating apparatus 20 can regulate displacement of the sheet bundle. Therefore, when performing binding at two or more locations, it is possible to prevent position deviation of the sheet bundle.

Modified Example 2 of First Embodiment

Figure 14:
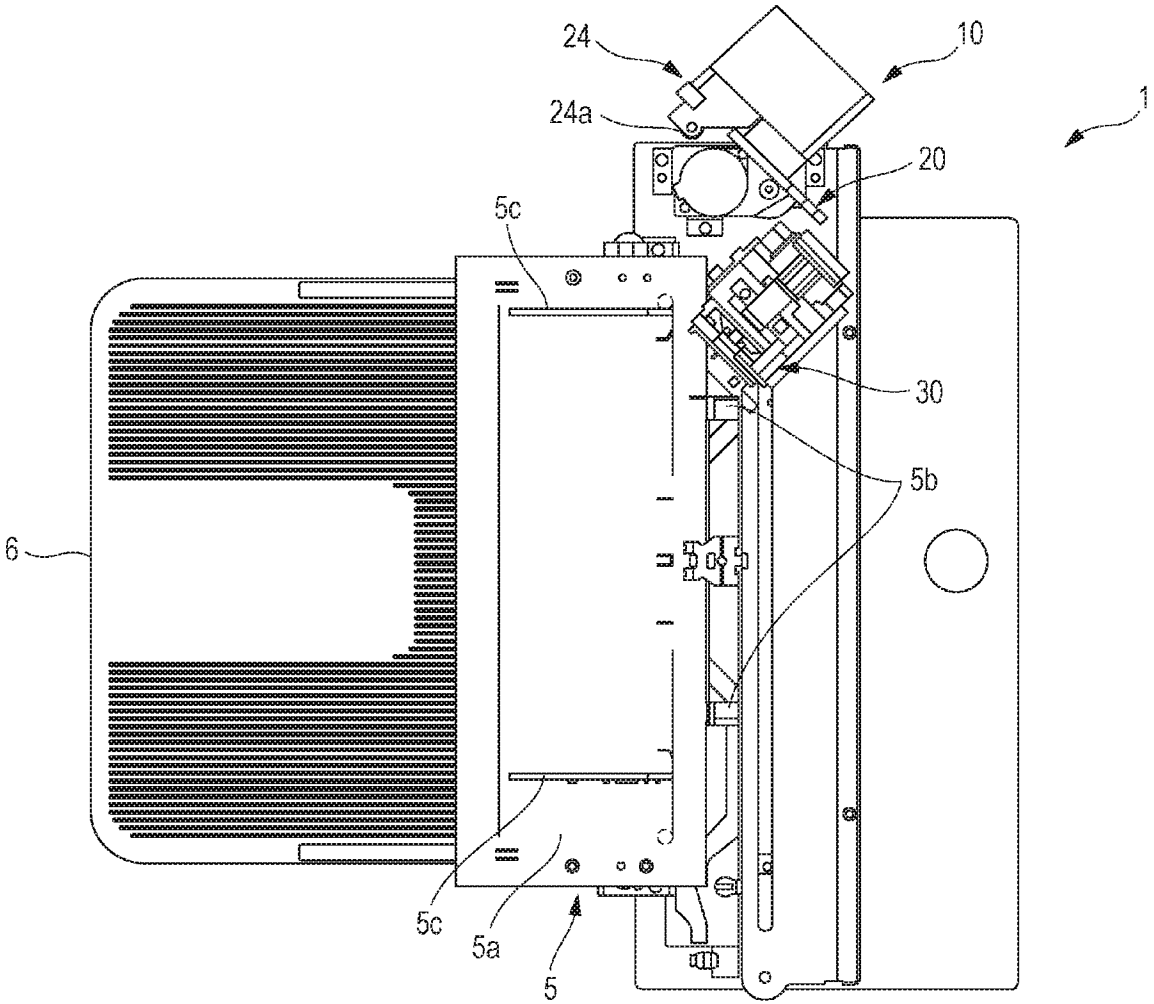
FIG. 14 is a partial top view of a modified example 2 of the sheet processing apparatus of the first embodiment of the present invention.

Next, a modified example 2 of the sheet processing apparatus 1 of the first embodiment will be described with reference to FIG. 14. FIG. 14 is a partial top view of the modified example 2 of the sheet processing apparatus 1.

As shown in FIG. 14, the modified example 2 of the sheet processing apparatus 1 of the first embodiment includes a staple apparatus 30 in addition to the binding apparatus 10.

The staple apparatus 30 is provided near a rear side end portion in the sheet width direction and on the upstream side of the intermediate tray 5 in the sheet conveyance direction. The staple apparatus 30 is formed into a substantially rectangular parallelepiped shape having a substantially rectangular shape in plan view and, for example, is arranged inclined at an angle of 45° with respect to the sheet conveyance direction. Thereby, the staple apparatus 30 performs staple processing using a metal needle on a corner portion of the sheet bundle having a rectangular shape in plan view in a state in which the staple apparatus 30 is inclined at an angle of 45° with respect to the sheet conveyance direction, and binds the sheet bundle.

When the sheet processing apparatus 1 performs staple binding processing by using the staple apparatus 30, as shown in FIG. 14, the binding apparatus 10 retreats to the rear side with respect to the sheet placement surface 5*a* of the intermediate tray 5. According to this configuration, it is possible to use the staple apparatus 30 in addition to the binding apparatus 10 in the sheet processing apparatus 1.

Second Embodiment

Figure 15:
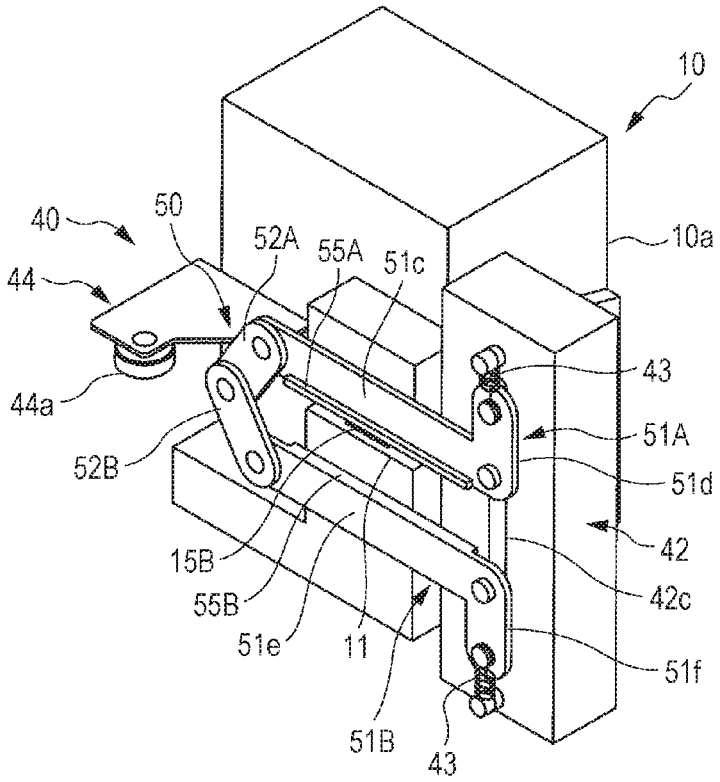
FIG. 15 is a perspective view of a binding apparatus of a sheet processing apparatus of a second embodiment of the present invention.
Figure 16:
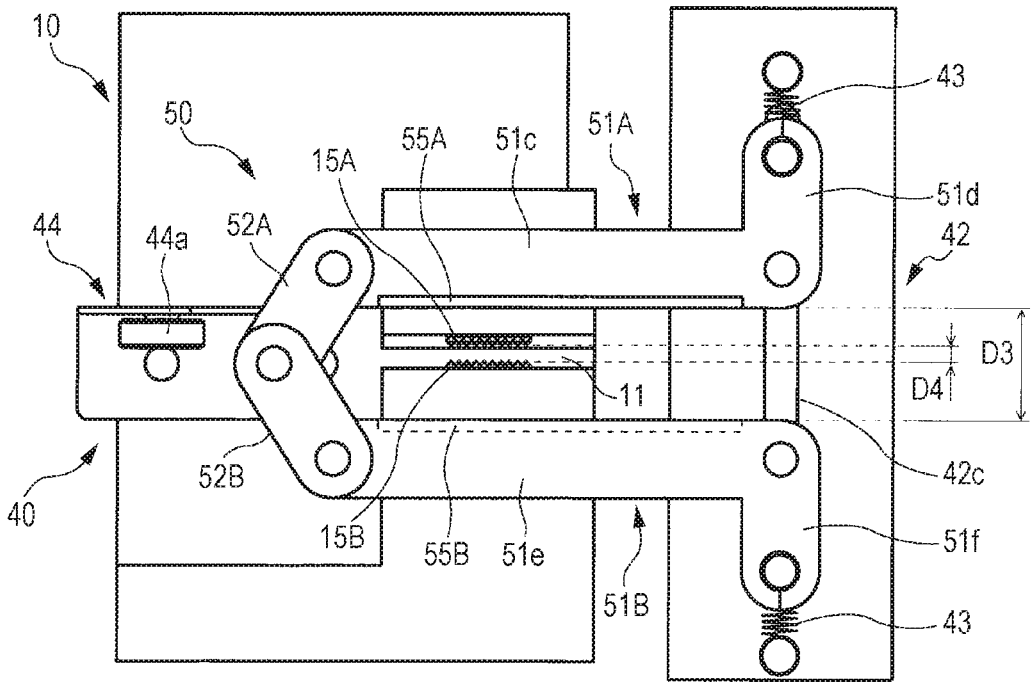
FIG. 16 is a front view of the binding apparatus of the sheet processing apparatus of the second embodiment of the present invention.
Figure 17:
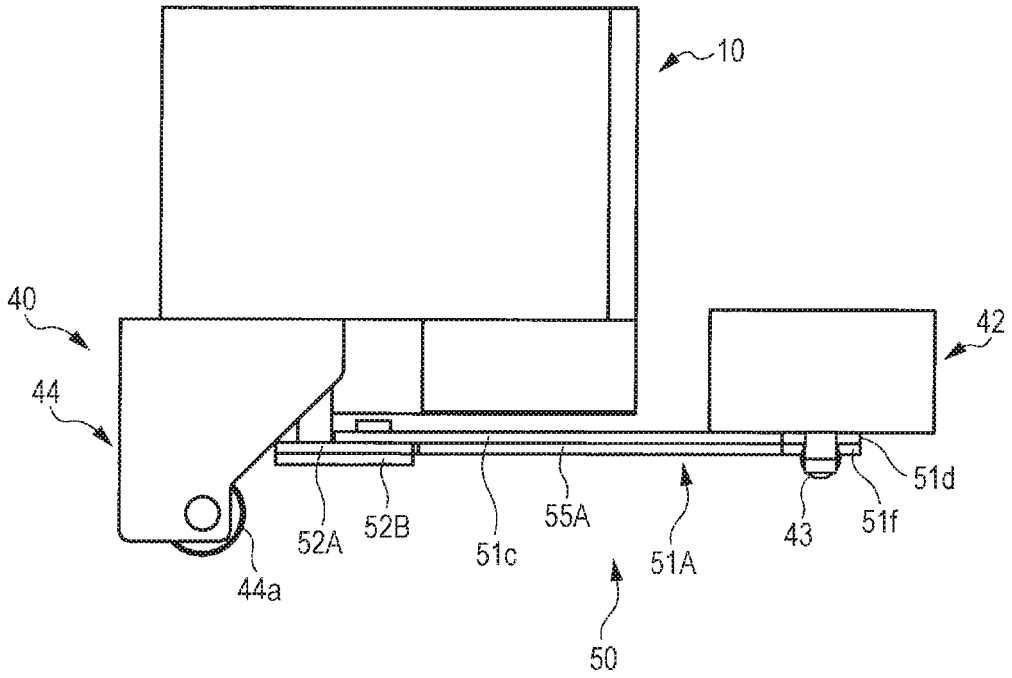
FIG. 17 is a top view of the binding apparatus of the sheet processing apparatus of the second embodiment of the present invention.
Figure 18:
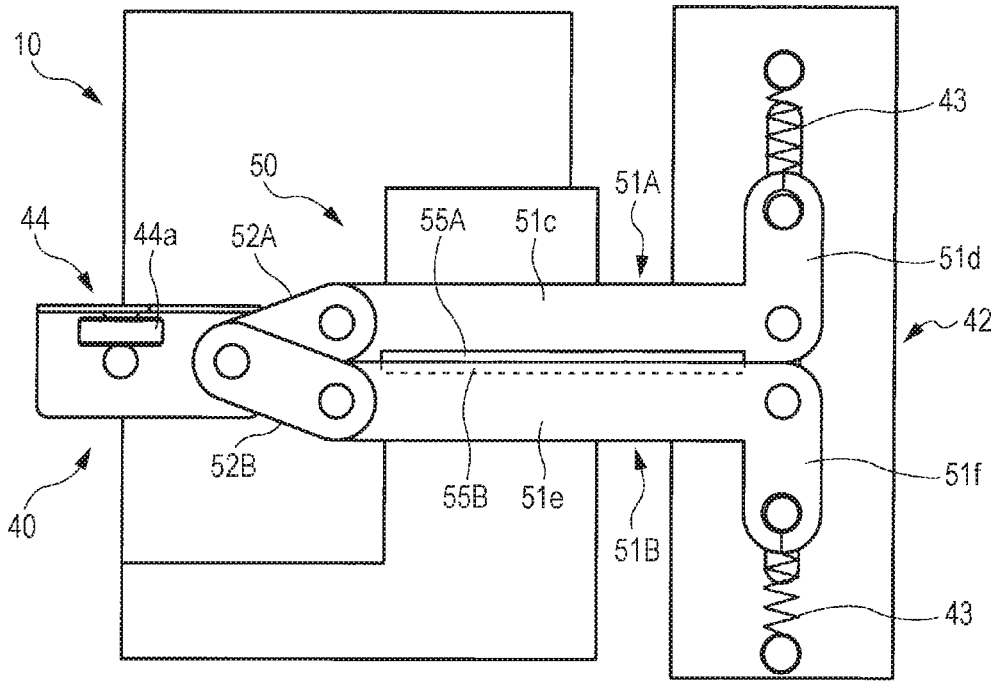
FIG. 18 is a front view showing a binding state of a sheet bundle of the binding apparatus of the sheet processing apparatus of the second embodiment of the present invention.
Figure 19:
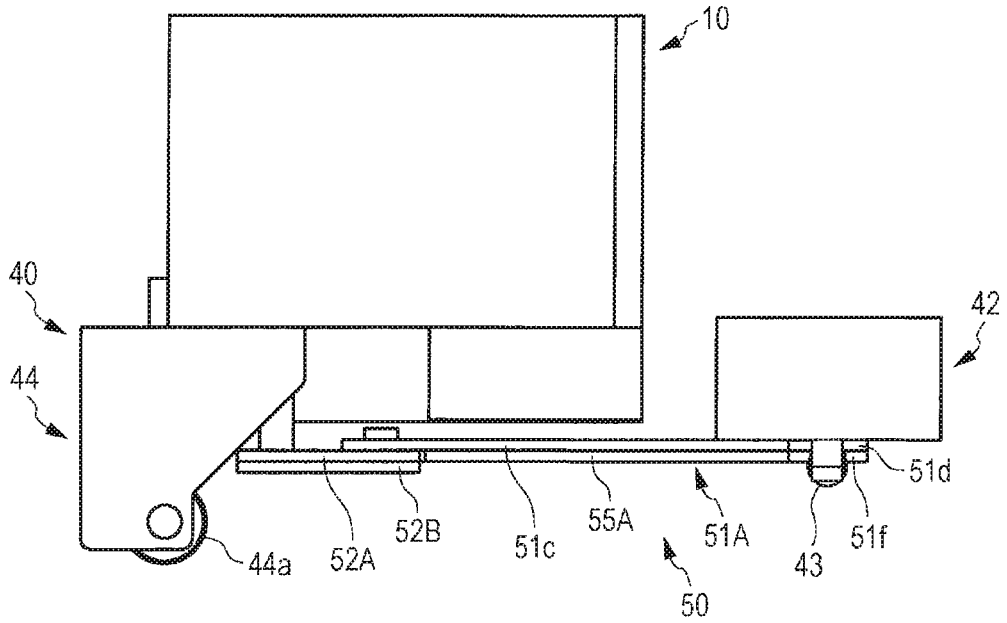
FIG. 19 is a top view showing the binding state of the sheet bundle of the binding apparatus of the sheet processing apparatus of the second embodiment of the present invention.

Next, a sheet processing apparatus of the second embodiment of the present invention will be described with reference to FIGS. 15 to 19. FIGS. 15, 16, and 17 are a perspective view, a front view, and a top view of a binding apparatus of the sheet processing apparatus of the second embodiment of the present invention. FIGS. 18 and 19 are a front view and a top view showing a binding state of a sheet bundle of the binding apparatus of the sheet processing apparatus. A basic configuration of the second embodiment is the same as that of the first embodiment described above, so that components common to those of the first embodiment are denoted by the same names and the same reference numerals, and detailed description thereof may be omitted.

The sheet processing apparatus of the second embodiment includes a binding apparatus 10 shown in FIGS. 15 to 17. The binding apparatus 10 supports a regulating apparatus 40 of a sheet bundle. The regulating apparatus 40 is arranged close to the opening portion 11 of the binding apparatus 10. The regulating apparatus 40 includes a link structure 50 including two link members 51A and 51B which are a pair of regulating members, a support member 42, a spring 43, and a slide member 44.

The link structure 50 includes two link members 51A and 51B and two connecting links 52A and 52B. The two link members 51A and 51B are provided on a front side of the binding apparatus 10 and on a sheet bundle side in front of the opening portion 11. The two link members 51A and 51B are arranged close to the binding members 12A and 12B. The two link members 51A and 51B are laid in substantially parallel with each other above and below the sheet bundle with the sheet bundle in between.

The two link members 51A and 51B are configured into an L shape in a front view. The upper link member 51A has a parallel portion 51*c* extending in a direction substantially in parallel with front and rear surfaces of the sheet bundle and a bent portion 51*d* that bends upward. The lower link member 51B has a parallel portion 51*e* extending in a direction substantially in parallel with front and rear surfaces of the sheet bundle and a bent portion 51*f* that bends downward. One ends of the two link members 51A and 51B on the side of the bent portions 51*d* and 51*f* are supported by the support member 42, and the other ends on the side of the parallel portions 51*c* and 51*e* are supported by the slide member 44 through the two connecting links 52A and 52B.

The two link members 51A and 51B respectively have a pair of regulating pieces 55A and 55B facing each other with the sheet bundle in between. The pair of regulating pieces 55A and 55B are provided close to the opening portion 11. The pair of regulating pieces 55A and 55B are arranged in front of the opening portion 11 formed into a rectangular shape extending in a direction substantially in parallel with the front and rear surfaces of the sheet bundle when the housing 10*a* is viewed from the front. Each of the pair of regulating pieces 55A and 55B is formed into a substantially plate shape extending in a direction substantially in parallel with the front and rear surfaces of the sheet bundle along a lower edge portion of the parallel portion 51*c* of the upper link member 51A or un upper edge portion of the parallel portion 51*e* of the lower link member 51B.

The pair of regulating pieces 55A and 55B interlock with the link members 51A and 51B. The pair of regulating pieces 55A and 55B approach and/or come into contact with a corner portion of the sheet bundle, which is inserted into inside of the housing 10*a* from the opening portion 11, from the vertical direction. Thereby, the two link members 51A and 51B regulate displacement of the sheet bundle in directions approaching and moving away from the crimping teeth 15A and 15B by using the pair of regulating pieces 55A and 55B.

The support member 42 is provided beside a main body unit of the binding apparatus 10 on the upstream side of the main body unit of the binding apparatus 10 in the sheet conveyance direction. The support member 42 has a rail portion 42*c* extending in the vertical direction crossing the opening portion 11 on its front side facing the placed sheet bundle. The bent portions 51*d* and 51*f* of the two link members 51A and 51B individually engage the rail portion 42*c*. Each of the bent portions 51*d* and 51*f* extending in the vertical direction engages the rail portion 42*c* at two (high and low) positions.

The two link members 51A and 51B can move in the vertical direction along a direction in which the rail portion 42*c* extends, and their parallel portions 51*c* and 51*e*, that is, the regulating pieces 55A and 55B, move in the vertical direction while maintaining a parallel state. Thereby, the pair of regulating pieces 55A and 55B can move between the regulating positions where the regulating pieces 55A and 55B approach the opening portion 11 and regulate displacement of the sheet bundle and the retreat positions where the regulating pieces 55A and 55B move away from the opening portion 11 in the vertical direction and retreat from the regulating positions.

The spring 43 is attached to the support member 42. The spring 43 is provided to two positions which are above and below the rail portion 42*c*. The spring 43 is composed of, for example, an extension coil spring. One end of one spring 43 is connected to the support member 42 at a position higher than an upper end of the rail portion 42*c* and the other end is connected to the bent portion 51*d* of the upper link member 51A. One end of the other spring 43 is connected to the support member 42 at a position lower than a lower end of the rail portion 42*c* and the other end is connected to the bent portion 51*f* of the lower link member 51B. The springs 43 expand and contract in the vertical direction along with vertical movement of the bent portions 51*d* and 51*f* along the rail portion 42*c*. Thereby, the springs 43 energize the pair of regulating pieces 55A and 55B toward the retreat positions.

The slide member 44 is provided to an opposite side of an area, where the support member 42 is arranged, with an area where the opening portion 11 is provided in between. One ends of the two connecting links 52A and 52B are collectively connected to one position of the slide member 44 at the same height as the opening portion 11 in the vertical direction. The two connecting links 52A and 52B have the same shape and the same length, and the other ends of the two connecting links 52A and 52B are connected to end portions of the parallel portions 51*c* and 51*e* of the two link members 51A and 51B.

When the side fence 5*c* on the rear side of the sheet bundle is not in contact with or is slightly in contact with the contact member 44*a* of the slide member 44, a force against the energizing force of the springs 43 is hardly applied to the two connecting link members 51A and 51B. Thereby, the springs 43 move the pair of regulating pieces 55A and 55B to the retreat positions.

Subsequently, when the slide member 44 comes into contact with the side fence 5*c* on the rear side of the sheet bundle and interlocks with the side fence 5*c*, the slide member 44 moves in a direction moving away from the support member 42. Thereby, the slide member 44 pulls the two connecting links 52A and 52B in a direction moving away from the opening portion 11. Further, the slide member 44 moves the upper link member 51A downward and moves the lower link member 51B upward through the two connecting links 52A and 52B against the energizing force of the spring 43. The pair of regulating pieces 55A and 55B come into contact with each other through the sheet bundle or come close to each other. In other words, the two link members 51A and 51B regulate displacement of the sheet bundle in directions approaching and moving away from the crimping teeth 15A and 15B by using the pair of regulating pieces 55A and 55B.

After the crimping/binding processing of the sheet bundle, the side fence 5*c* on the rear side of the sheet bundle approaches the sheet bundle to move to the front side. Thereby, a force by which the slide member 44 pulls the connecting links 52A and 52B in a direction moving away from the opening portion 11 decreases, so that the springs 43 move the upper link member 51A upward and move the lower link member 51B downward. In other words, the springs 43 move the pair of regulating pieces 55A and 55B to the retreat positions.

Also in the second embodiment, as shown in FIG. 16, a separation distance D3 between the pair of regulating pieces 55A and 55B at the retreat positions of the pair of the regulating pieces 55A and 55B at which the pair of regulating pieces 55A and 55B retreat from the regulating positions where the pair of regulating pieces 55A and 55B regulate displacement of the sheet bundle is longer than a separation distance D4 between the pair of crimping teeth 15A and 15B at the retreat positions of the pair of the crimping teeth 15A and 15B at which the pair of crimping teeth 15A and 15B retreat from the binding positions where the pair of crimping teeth 15A and 15B bind the sheet bundle. According to this configuration, it is possible to exclude factors that cause a failure of insertion of the sheet bundle into a binding area of the sheet bundle when inserting the sheet bundle into the binding area of the sheet bundle.

The sheet processing apparatus 1 of the second embodiment also moves the pair of crimping teeth 15A and 15B and the pair of regulating pieces 55A and 55B to their retreat positions, the sheet processing apparatus 1 holds the pair of regulating pieces 55A and 55B at the regulating positions until a separation distance between the pair of crimping teeth 15A and 15B reaches a predetermined separation distance. According to this configuration, after the crimping processing, when the pair of crimping teeth 15A and 15B are separated from each other, the pair of regulating pieces 55A and 55B are held at the regulating positions until the separation distance between the crimping teeth 15A and 15B reaches the predetermined separation distance. In other words, it is possible to regulate displacement of the sheet bundle in directions approaching and moving away from the crimping teeth 15A and 15B until the crimping teeth 15A and 15B are sufficiently separated from each other. Therefore, it is possible to effectively improve function to prevent the sheet S from attaching to the crimping teeth 15A and 15B.

While the embodiments of the present invention have been described, the scope of the invention is not limited thereto, and the invention can be implemented by adding various modifications without departing from the scope of the invention.

For example, while the embodiments described above use two wires or two link members as a pair of regulating members, the pair of regulating members may be configured by other members instead of the wires or the link members.

Further, while the embodiments described above use the side fence 5*c* provided on the rear side of the sheet bundle as a driving part that displaces the two wires 21A and 21B and the two link members MA and MB, a motor similar to that of the driving part of the binding members 12A and 12B may be used instead of the side fence 5*c*. When using a motor, a motive power may be transmitted from a motor for conveying the sheet S, or the like.

The present invention can be used in an image forming apparatus such as, for example, a copier.

Although embodiments of the present invention have been described and illustrated in detail, the disclosed embodiments are made for purposes of illustration and example only and not limitation. The scope of the present invention should be interpreted by terms of the appended claims.

What is claimed is:

1. A sheet processing apparatus comprising:

a pair of binding members that respectively have a pair of crimping teeth facing each other, which move between binding positions where a sheet bundle is bound and retreat positions retreated from the binding positions; and a pair of regulating members that are arranged close to the binding members and respectively have a pair of regulating pieces which face each other and move between regulating positions where displacement of the sheet bundle bound by the pair of crimping teeth is regulated and retreat positions retreated from the regulating positions, wherein a separation distance between the pair of regulating pieces at the retreat positions of the regulating pieces is longer than a separation distance between the pair of crimping teeth at the retreat positions of the crimping teeth.

2. The sheet processing apparatus according to claim 1, wherein each of the pair of crimping teeth individually moves with respect to the binding position and the retreat position.

3. The sheet processing apparatus according to claim 1, wherein after the pair of crimping teeth located at the binding positions are moved to the retreat positions of the crimping teeth, the pair of regulating pieces located at the regulating positions are moved to the retreat positions of the regulating pieces.

4. The sheet processing apparatus according to claim 1, wherein the pair of regulating members are provided to be able to operate independently from the pair of binding members.

5. The sheet processing apparatus according to claim 1, wherein a driving part of the binding members is different from a driving part of the regulating members.

6. The sheet processing apparatus according to claim 1, wherein the pair of regulating members displace in a direction crossing a moving direction of the pair of crimping teeth.

7. The sheet processing apparatus according to claim 1, further comprising:

an aligning member that is provided movably in a direction crossing a sheet conveyance direction and comes into contact with a sheet bundle from outside in a direction crossing the sheet conveyance direction; and a slide member that supports the pair of regulating members, comes into contact with the aligning member, and interlocks with the aligning member, wherein the slide member comes into contact with and interlocks with the aligning member, and the pair of regulating pieces move to the regulating positions through the pair of regulating members.

8. The sheet processing apparatus according to claim 1, wherein the pair of regulating members include two wires which are laid in substantially parallel with each other with a sheet bundle in between, and the sheet processing apparatus further includes a support tool that immovably supports one ends of the two wires, a slide member that moves the other ends of the two wires substantially in parallel with a surface of the sheet bundle and moves the pair of regulating pieces toward the regulating positions, and an energizing member that energizes the pair of regulating pieces toward the retreat positions.

9. The sheet processing apparatus according to claim 1, wherein the pair of regulating members include two link members which are laid in substantially parallel with each other with a sheet bundle in between, and the sheet processing apparatus further includes a link structure that includes the two link members and moves the pair of regulating pieces toward the regulating positions, and an energizing member that energizes the pair of regulating pieces toward the retreat positions.

10. The sheet processing apparatus according to claim 1, wherein the pair of regulating pieces are arranged on an upstream side of the pair of crimping teeth in an insertion direction of the sheet bundle.

11. The sheet processing apparatus according to claim 1, wherein a separation distance between the pair of regulating pieces can be adjusted.

12. The sheet processing apparatus according to claim 1, wherein the pair of regulating members and the pair of binding members are unitized.

13. An image forming apparatus comprising the sheet processing apparatus according to claim 1.

14. A sheet processing apparatus comprising:

a pair of binding members that respectively have a pair of crimping teeth facing each other, which move between binding positions where a sheet bundle is bound and retreat positions retreated from the binding positions; and a pair of regulating members that are arranged close to the binding members and respectively have a pair of regulating pieces which face each other and move between regulating positions where displacement of the sheet bundle bound by the pair of crimping teeth is regulated and retreat positions retreated from the regulating positions, wherein when the pair of crimping teeth and the pair of regulating pieces are moved to their retreat positions, the pair of regulating pieces are held at the regulating positions until a separation distance between the pair of crimping teeth reaches a predetermined separation distance, and wherein the pair of binding members and the pair of regulating members are provided to be able to move independently from each other.

15. The sheet processing apparatus according to claim 14, wherein after the pair of crimping teeth located at the binding positions are moved to the retreat positions of the crimping teeth, the pair of regulating pieces located at the regulating positions are moved to the retreat positions of the regulating pieces.

16. The sheet processing apparatus according to claim 14, wherein when the pair of crimping teeth and the pair of regulating pieces are moved to the binding positions or the regulating positions, after the pair of regulating pieces are moved to the regulating positions, the pair of crimping teeth are moved to the binding positions.

17. The sheet processing apparatus according to claim 14, wherein when the pair of regulating pieces come into contact with a sheet bundle at the regulating positions, the pair of regulating pieces come into line contact with the sheet bundle.

18. The sheet processing apparatus according to claim 14, wherein the pair of regulating members move the pair of regulating pieces in a direction crossing a surface of the sheet bundle.

19. The sheet processing apparatus according to claim 14, wherein each of the pair of regulating pieces individually moves with respect to the regulating position and the retreat position.

20. An image forming apparatus comprising the sheet processing apparatus according to claim 14.

* * * * *